United States Patent [19]

Bottoms et al.

[11] 4,233,005

[45] Nov. 11, 1980

[54] HYDRAULIC GEAR PUMP WITH RECESSES IN NON-WORKING GEAR FLANKS

[75] Inventors: Harry S. Bottoms, Henley-in-Arden; Ronald A. Heath, Birmingham, both of England

[73] Assignee: Lucas Industries Limited, Birmingham, England

[21] Appl. No.: 974,039

[22] Filed: Dec. 28, 1978

[30] Foreign Application Priority Data

Jan. 18, 1978 [GB] United Kingdom ..... 1997/78

[51] Int. Cl.[3] ..... F04C 2/18; F04C 15/00

[52] U.S. Cl. ..... 418/190

[58] Field of Search ..... 418/77, 189, 190

[56] References Cited

U.S. PATENT DOCUMENTS

| | | | |
|---|---|---|---|
| 1,686,867 | 10/1928 | Kuhn | 418/190 |
| 2,344,628 | 3/1944 | Monahan | 418/190 |
| 2,354,992 | 8/1944 | Gottlieb | 418/189 |
| 2,601,003 | 6/1952 | Pontius | 418/190 |
| 3,113,524 | 12/1963 | Fulton | 418/189 |
| 3,303,792 | 2/1967 | Littlewood | 418/189 |
| 3,439,625 | 4/1969 | Warne | 418/190 |
| 3,953,160 | 4/1976 | Bottoms | 418/190 |

FOREIGN PATENT DOCUMENTS

| | | | |
|---|---|---|---|
| 71772 | of 1943 | Czechoslovakia | 418/190 |
| 722158 | 7/1942 | Fed. Rep. of Germany | 418/190 |
| 578809 | 7/1946 | United Kingdom | 418/190 |
| 739357 | 10/1955 | United Kingdom | 418/189 |

*Primary Examiner*—John J. Vrablik

[57] ABSTRACT

A gear pump has a pair of externally meshed gears, and an inlet port and an outlet port on respective sides of the zone of mesh of the gears. The teeth of the gears have their non-working flanks relieved so as to increase an inter-tooth volume lying between two adjacent contact areas of the gears, this inter-tooth volume first decreasing and then increasing as the gears rotate. The relief of the non-working flanks is such that each successive inter-tooth volume communicates with the inlet port before that volume increases from its minimum value.

7 Claims, 9 Drawing Figures

HYDRAULIC GEAR PUMP WITH RECESSES IN NON-WORKING GEAR FLANKS

This invention relates to hydraulic pumps of the kind having a pair of intermeshed, externally toothed gear elements, and in particular to such pumps when intended for use in aircraft fuel systems.

If a pump of the foregoing kind is always driven in the same direction, only one flank hereinafter called the "working flank", of each gear tooth engages the teeth of the other gear, a small clearance, or backlash gap, being present between the other flank, hereinafter called the "non-working flank", of each tooth and the other gear. During pump operation there are periods when two working flanks of one of the gears are in contact with two working flanks on the other gear. There is thus a volume, hereinafter called the inter-tooth volume, defined between the two pairs of working flanks which are in contact, this volume including the foresaid backlash gap.

As the gears rotate each inter-tooth volume first reduces and subsequently increases. During this volume change, the proportions of the inter-tooth volume on respective sides of the backlash gap also alter, so that fluid is transferred from one side of the backlash gap to the other side thereof, within the inter-tooth volume. These volume changes result in transient pressure changes within the inter-tooth volumes. When fuel is being pumped, reductions in fuel pressures as a result of the aforesaid volume changes will result in air coming out of solution, and in the creation of bubbles of fuel vapour. A subsequent increase in fuel pressure will result in collapse of the vapour bubbles. When aircraft fuel pumps are used at high altitudes, the low air content of the fuel will result in rapid collapse of the vapour bubbles which, if occurring close to a metal surface, will cause cavitation erosion.

It has been proposed, in British Pat. No. 1,467,441, to reduce the aforesaid pressure changes, and hence the cavitation effects by providing recesses on the non-working flanks of the gear teeth. These recesses reduce the velocity of fuel flowing through the backlash gap and also increase the inter-tooth volumes, and therefore reduce the percentage of their changes of volume during a meshing cycle. It has also been proposed to arrange that the porting of the pump is such as to permit the gear cavities to communicate with at least the pump inlet port during the time in which the inter-tooth volume is increasing, and thereby to prevent excessive reduction in pressure in these spaces. It has been found, however, that such an arrangement does not prevent cavitation erosion of the gear teeth, since fuel entering the inter-tooth volumes from the pump inlet port causes any cavitation voids to be urged against the gear teeth and subsequently to collapse adjacent the gear teeth.

It is an object of the present invention to provide a gear pump in which the damage due to cavitation erosion is substantially reduced. The present invention, in effect, causes the inter-tooth volumes to communicate with the pump inlet port before these volumes increase from their minimum value.

According to the invention there is provided a hydraulic pump comprising a housing, a pair of meshed externally-toothed gear elements in a chamber within the housing, said housing having inlet and outlet ports which communicate with said chamber on opposite sides of a zone in which said gear elements are meshed, the non-working flank of each gear tooth having recesses adjacent the end faces of the gear element and an unrecessed land extending from the root to the tip of the tooth between said recesses, adjacent pairs of contact points between said gears defining, together with said non-working flanks, an inter-tooth volume whose capacity changes as said gears rotate, each said inter-tooth volume comprising two volumes on respective sides of a minimum clearance between said non-working flanks, one of said two volumes increasing and the other of said two volumes decreasing after said minimum clearance has passed through the pitch point of the gears, said inlet port, said inter-tooth volumes being dimensioned so that each said inter-tooth volume first communicates with said inlet port at a time not later than that at which said minimum clearance passes through said pitch point.

An embodiment of the invention will now be described by way of example only and with reference to the accompanying drawings in which.

Figure 1:
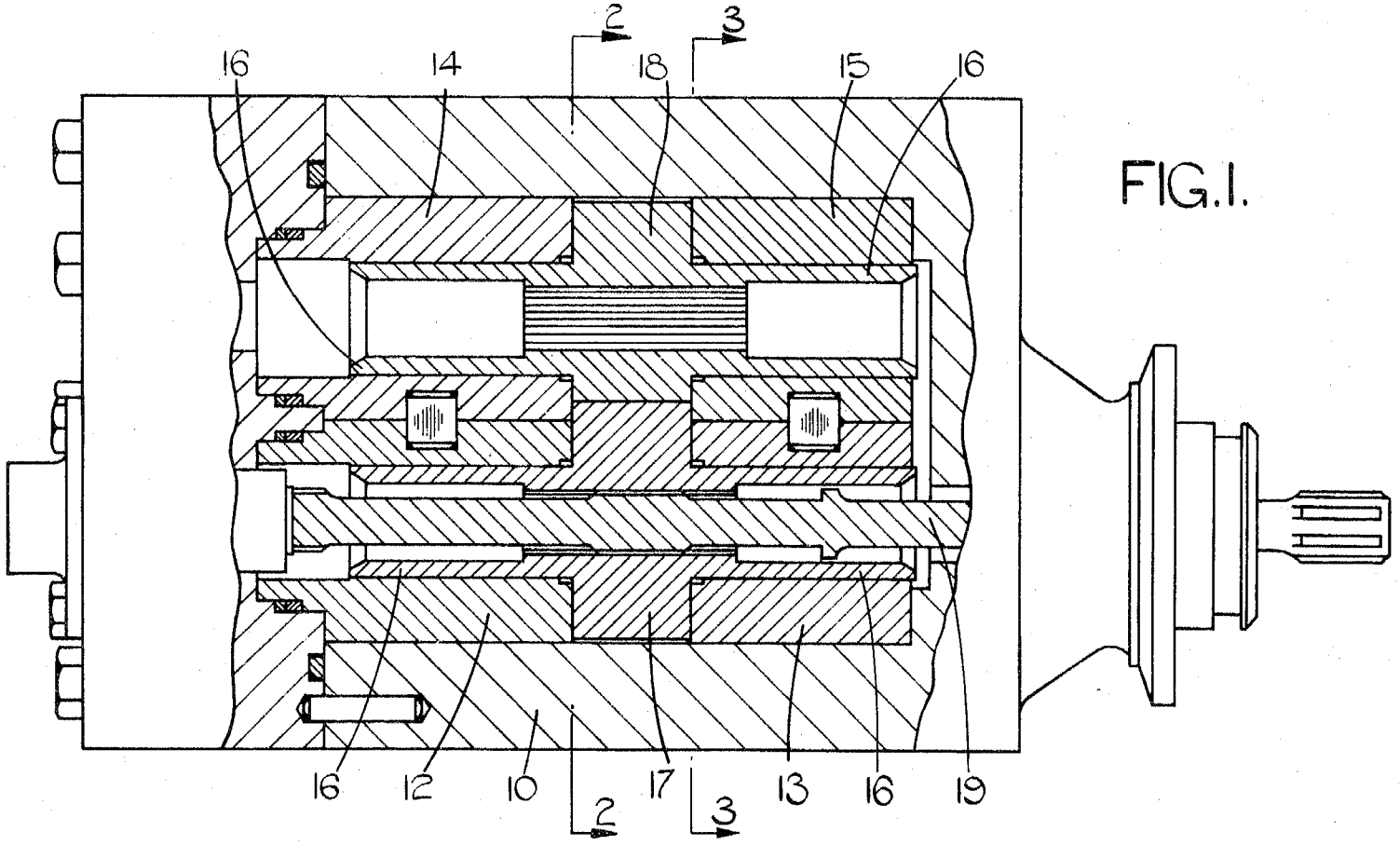
FIG. 1 is a longitudinal section through a gear pump.
Figure 2:
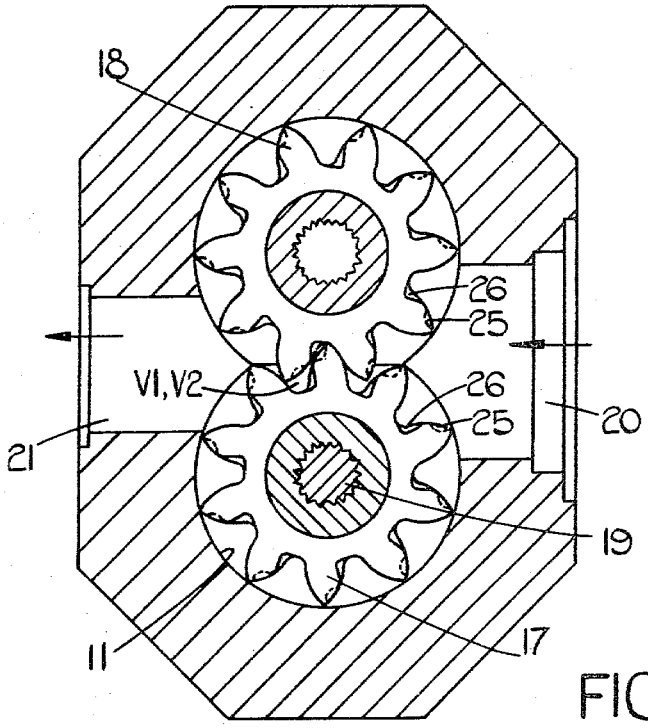
FIG. 2 is a section on line 2—2 in FIG. 1.
Figure 3:
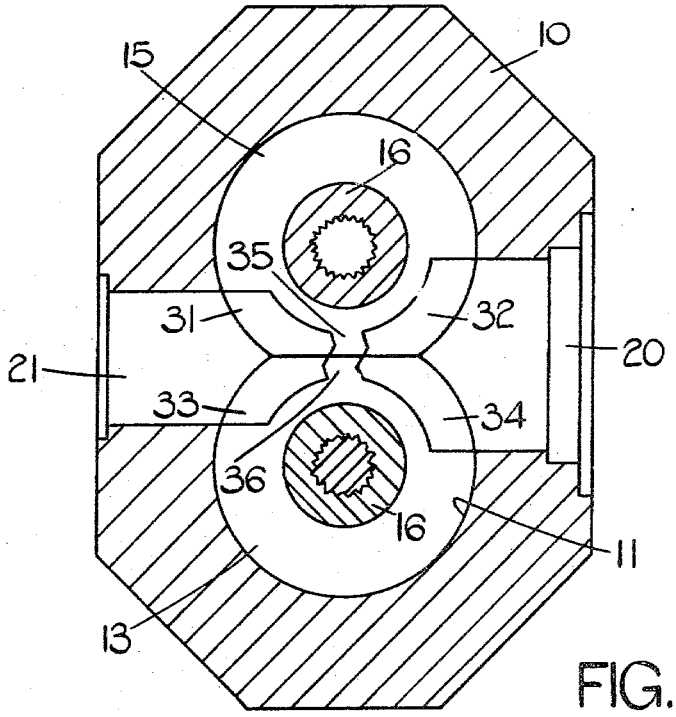
FIG. 3 is a section on lines 3—3 in FIG. 1.
Figure 4:
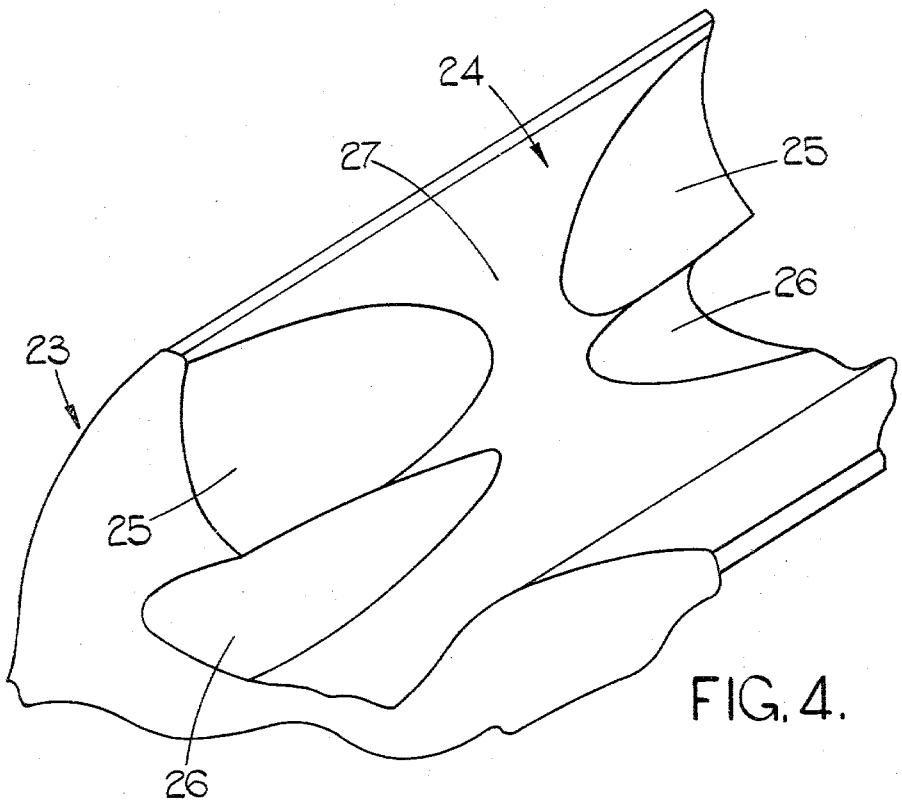
Figure 5:
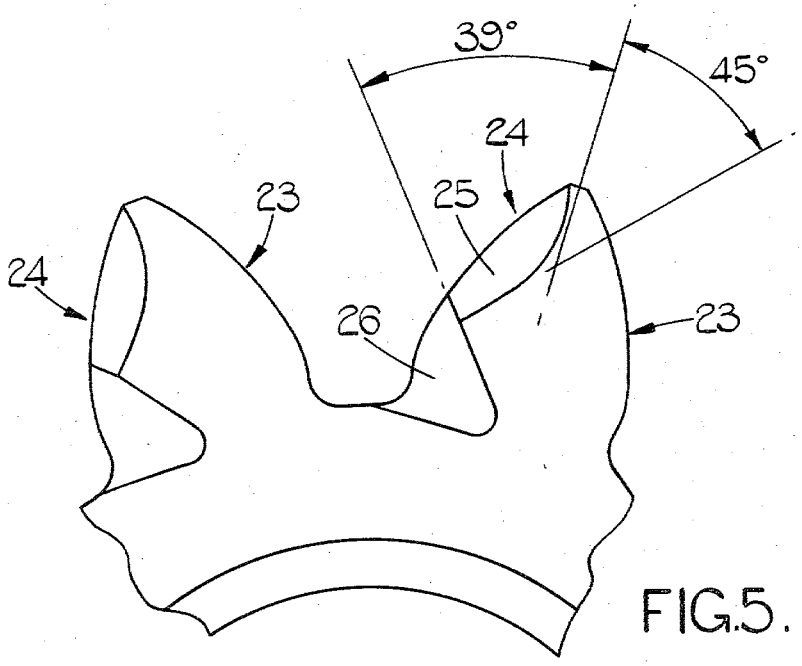
Figure 6:
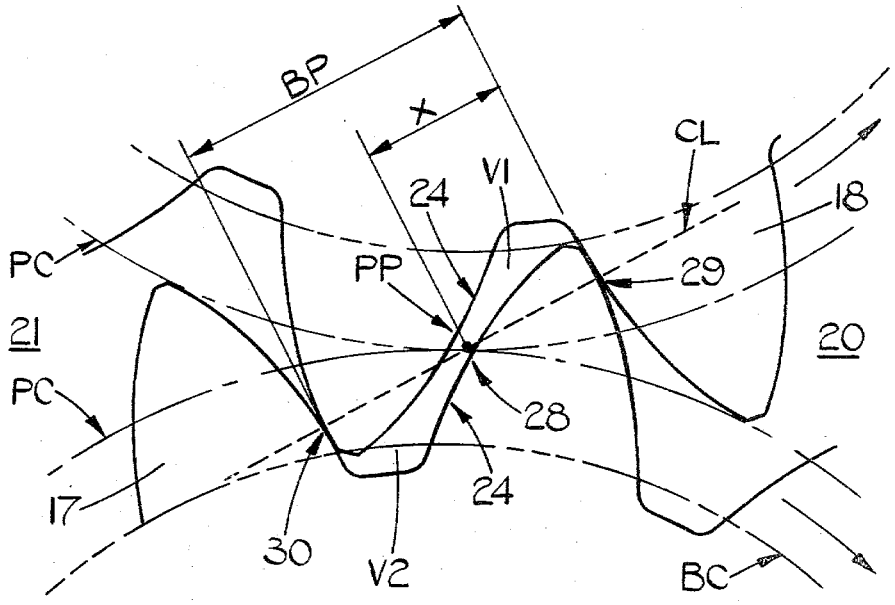
Figure 7:
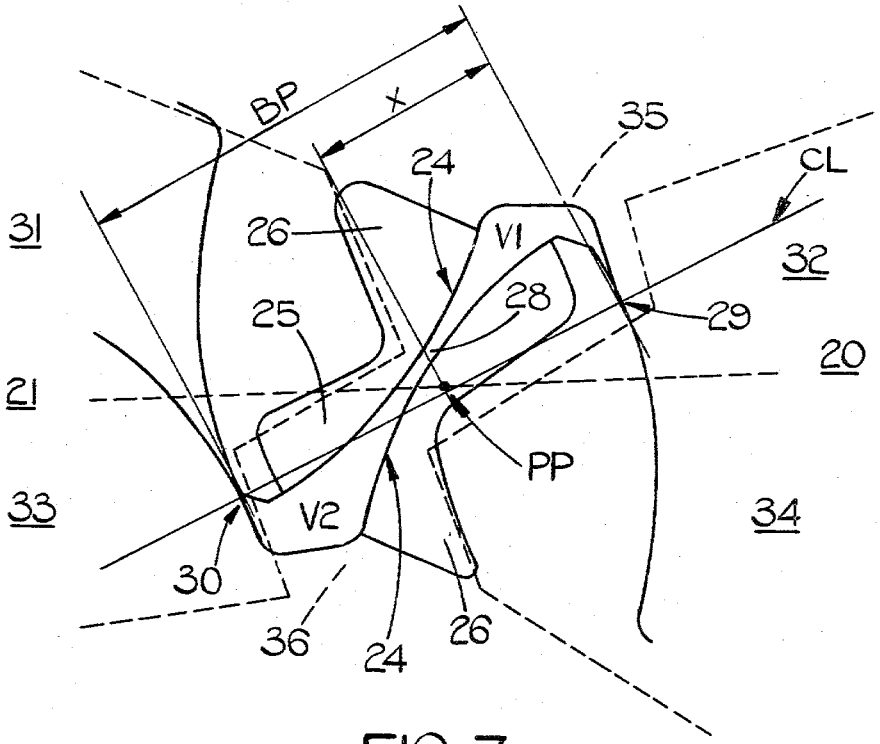
Figure 8:
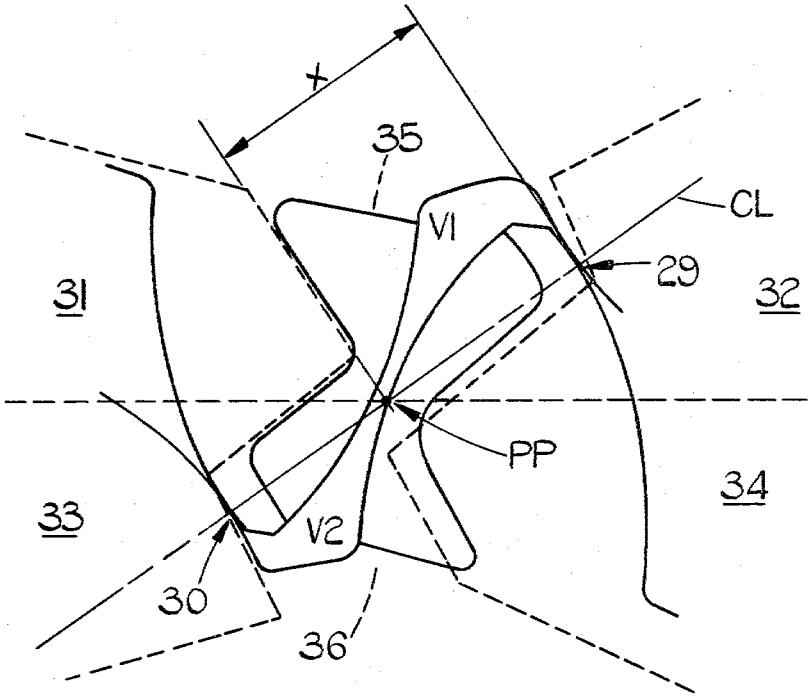
Figure 9:
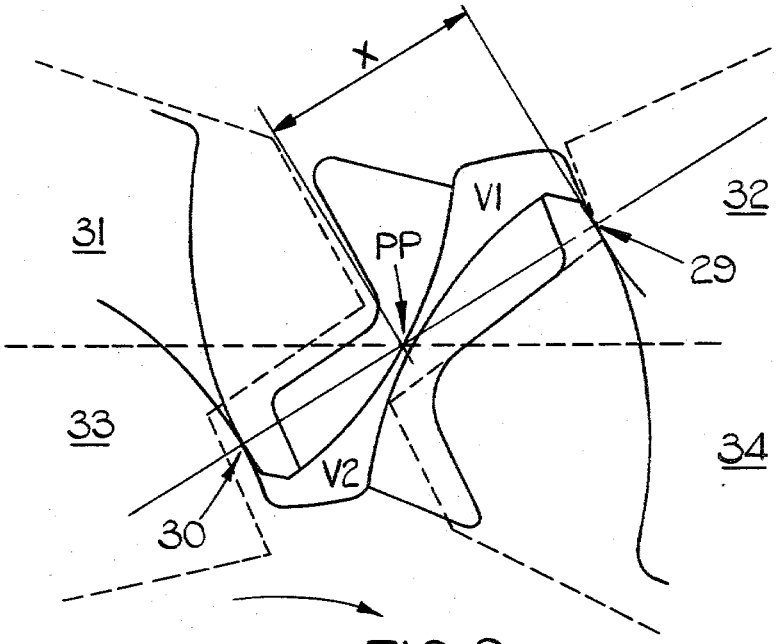

FIG. 4 is an enlarged perspective view of one tooth of a gear forming part of the pump, FIG. 5 is an end view of part of a gear element of the pump, FIG. 6 is a diagram illustrating the parameters referred to in the description, FIG. 7 is an enlarged view, corresponding to a part of FIG. 3 of one relative position of the meshed gear elements, and FIGS. 8 and 9 are views, corresponding to FIG. 7 of other relative mesh positions of the gear elements.

The pump includes a housing 10 formed with a pair of identical parallel bores whose axes are spaced by a distance less than the diameter of the bores so as to define a chamber 11 within the housing 10. Mounted within these bores are two pairs of bearing blocks 12, 13, 14, 15 each of which has a part cylindrical surface and a flat surface which abuts a flat surface in the other block of the pair. The blocks 12, 13, 14, 15 support trunnions 16 on two gears 17, 18 of identical pitch diameters which are interposed between the bearing blocks and are meshed together. The gear 17 is connected to a splined drive shaft 19, and the gear 18 is driven by the gear 17. The housing 10 has an inlet port 20 and an outlet port 21 which communicate with the chamber 11 on opposite sides of the zone of mesh of the gears 17, 18. The bearing blocks 12, 13, 14, 15 sealingly abut the end faces of the gear elements 17, 18.

Each tooth 22 of each gear 17, 18 as shown in FIGS. 4 and 5 a working flank 23 and a non-working flank 24. The non-working flanks 24 of all the teeth of both gears are provided with interpenetrating recesses 25, 26 which are milled out of the non-working flanks adjacent the end faces of the gears, so as to leave an unrelieved land 27 which extends from the root to the tip of the non-working face between one of the recess groups 25, 26 and the other recess group. The angular dimensions of the recesses 25, 26 and their position in relation to the tooth form is shown more clearly in FIG. 5.

Referring to FIG. 6, the gears 17, 18 are involute gears having a pressure angle of 30°. The base circle BC of the gear 17 and the pitch circles PC of both gears are indicated, as is the contact line CL between the gears. The gear 17 is drivingly rotated clockwise, and drives the gear 18 anticlockwise. In the position shown the backlash gap 28 between the non-working flanks 24 of the gears lies on the pitch point PP, that is at the point at which the pitch circles PC touch and through which the contact line CL passes. The base pitch BP is indicated and is the distance between a leading meshing point 29 of a tooth of the drive gear 17 and a trailing meshing point 30 on the next adjacent tooth of the driver gear 17. Between the points 29, 30 there is defined an inter-tooth volume made up of two volumes V1, V2 on either side of the backlash gap 28. In the relative position of the gears shown in FIG. 6 volumes V1 and V2 are equal, and the total capacity of the inter-tooth volume is at its minimum. It will be understood that FIG. 6 is diagrammatic only, and for the purpose of providing a definition of the terms subsequently used. The gear teeth are shown in FIG. 6 without their recesses 25, 26 but it will be understood that in practice the volumes V1 and V2 each include the additional volumes provided by two recesses 25 and two recesses 26.

The capacity of the inter-tooth volume is thus increased, and the change in this capacity as the gears rotate is thereby a smaller percentage of the whole. Pressure changes within the inter-tooth volume are thereby reduced. Moreover, the recesses 25, 26 allow fuel to flow between the volumes V1 and V2 without being required to pass through the restriction formed by the backlash gap 28. Flow between the volumes V1 and V2 is thus at a relatively low velocity and does not cause turbulence which can give rise to cavitation.

Referring back to FIG. 3, the ends of the bearing blocks 12, 13, 14, 15 adjacent the gears have non-planar surfaces which permit liquid in the inlet port 20 and outlet port 21 to communicate with the spaces between the gear teeth right up to the zone of mesh of the gears. As shown, each bearing block has two relieved zones 31, 32 or 33, 34 which communicate with the respective ports 20, 21. The relieved zones are separated by bridge portions 35, 36 which prevent direct flow through the relieved zones from the outlet port 21 back to the inlet port 20.

FIGS. 7, 8 and 9 show the relationship between the relieved portions on the bearing blocks and the recesses in the gear teeth, which permit the inter-tooth volumes to communicate with the inlet and outlet ports. In these drawings the bearing blocks are shown in dotted outline, so that the relative positions of the relieved portions, 31, 32, 33, 34 and bridge portions 35, 36 relative to the backlash space may be more readily distinguished.

FIG. 7 shows the relative positions of the gears just as the volume V2, which includes the recess 25 on one tooth and the recess 26 on an adjacent tooth, is about to communicate with the inlet port 20 by way of the recess 34. In this position the leading contact point 29 between the driver and driven gears is spaced by a distance X from the pitch point PP. The distance X is between 0.4 BP and 0.5 BP. Preferably the value of X is 0.45 BP. In other words the inter-tooth volume communicates with the inlet port 20, by way of the relieved portion 34, before the size of the inter-tooth volume has started to increase. There is thus at this stage no tendency for fuel to be drawn from the inlet port 20 into the inter-tooth volume. Moreover, both the volumes V1 and V2 are in communication with the high pressure in the outlet port 21, via the relieved portions 31, 33. In the position shown in FIG. 7, therefore, fuel will tend to be expelled from the inter-tooth volume towards the inlet port 20, and bubbles likely to result in cavitation are expelled away from the gear teeth.

FIG. 8 shows the relative positions of the gears and of the bridge portions 35, 36 when the leading meshing point 29 has moved to an increased distance X from the pitch point PP. The condition shown in FIG. 8 corresponds generally to that shown in FIG. 6, the value X being between 0.45 BP and 0.55 BP, subject to the proviso that the value of X shown in FIG. 8 is greater than that shown in FIG. 7. In a preferred arrangement the value of X shown in FIG. 8 is 0.5 BP. In this condition the backlash gap 28 lies on the pitch point PP and the inter-tooth volume has just ceased communication with the relieved portions 31, 33 and hence is shut off from the outlet port 21. The inter-tooth volume is in communication with the inlet port, by way of the relieved portion 34, but since this volume is at its minimum value there is no tendency for fuel to flow into the inter-tooth volume at this time.

In the relative positions shown in FIG. 9 the leading contact point 29 has moved still further to a distance X of between 0.5 BP and 0.6 BP from the pitch point. In the embodiment shown the distance X is 0.55 BP. In this position the inter-tooth volume first communicates with the relieved portion 32. Though the inter-tooth volume as a whole is increasing, the volume V2 is decreasing and the volume V1 is increasing at a greater rate. There is thus no tendency for cavitation bubbles initially expelled, in the conditions shown in FIGS. 7 and 8, to re-enter the volume V2. It has been found that substantially all cavitation bubbles are expelled from the inter-tooth volume during the stages shown in FIGS. 7 and 8 and these bubbles are thereby kept away from the tooth flanks until after the bubbles collapse.

The drop in pressure in volume V2 as the latter communicates with the recess 34 is very rapid, since there is a considerable pressure difference, prior to this communication, between the fuel in the inter-tooth volume and that in the inlet port. This rapid pressure drop might in some circumstances cause the pressure in the inter-tooth volume to "overshoot" and fall below that in the inlet port. This is, however, prevented by the fact that the volume V2 continues to decrease, and when volume V1 communicates with the recess 32, as shown in FIG. 9, flow from volume V1 to volume V2 is very small or non-existent.

Furthermore, the connection of the inter-tooth volume to the inlet port before this volume reaches its minimum value, that is, at the time when the pressure in the inter-tooth volume is increasing at its maximum rate, prevents this pressure from reaching an unacceptably high level.

We claim:

1. A hydraulic pump comprising a housing, a pair of meshed externally-toothed gear elements in a chamber within the housing, said housing having inlet and outlet ports which communicate with said chamber on opposite sides of a zone in which said gear elements are in mesh, said housing including a bridge portion separating said inlet and outlet ports, the non-working flank of each gear tooth having recesses adjacent the end faces of the gear element and an unrecessed land extending from the root to the tip of the tooth between said recesses, adjacent pairs of contact points between said gears defining, together with said non-working flanks, an inter-tooth volume which includes said recesses and whose capacity changes as said gears rotate, each said inter-tooth volume comprising two volumes on respective sides of a minimum clearance between said non-working flanks, one of said two volumes increasing and the other of said two volumes decreasing after said minimum clearance has passed through the pitch point of the gears, said bridge portion providing means for co-operating with said tooth recesses so that said inlet and outlet ports intercommunicate through said inter-tooth volume at a time not later than that at which said minimum clearance passes through said pitch point, and said inter-tooth volume first communicates with said inlet port by way of said other volume.

2. A hydraulic pump comprising a housing, a pair of meshed externally-toothed gear elements in a chamber within the housing, said housing having inlet and outlet ports which communicate with said chamber on opposite sides of a zone in which said gear elements are meshed, the non-working flank of each gear tooth having recesses adjacent the end faces of the gear element and an unrecessed land extending from the root to the tip of the tooth between said recesses, adjacent pairs of contact points between said gears defining, together with said non-working flanks, an inter-tooth volume whose capacity changes as said gears rotate, each said inter-tooth volume comprising two volumes on respective sides of a minimum clearance between said non-working flanks, one of said to volumes increasing and the other of said two volumes decreasing after said minimum clearance has passed through the pitch point of the gears, said inlet port, said outlet port and said inter-tooth volumes being dimensioned so that each said inter-tooth volume first communicates with said inlet port at a time not later than that at which said minimum clearance passes through said pitch point, and said inter-tooth volume first communicates with said inlet port by way of said other volume.

3. A pump as claimed in claim 1 in which each said inter-tooth volume first communicates with said inlet port when the distance between the pitch point of the gears and the leading point of contact of the gears is between 0.4 and 0.5 of the base pitch of the gears.

4. A pump as claimed in claim 1 in which each said inter-tooth volume first communicates with said inlet port before moving out of communication with said outlet port.

5. A pump as claimed in claim 4 in which each said inter-tooth volume remains in communication with said outlet port until the distance between the pitch point of the gears and the leading point of contact of the gears is between 0.45 and 0.55 of the base pitch of the gears.

6. A pump as claimed in claim 4 in which said one volume first communicates with said inlet port after said inter-tooth volume has ceased to communicate with said outlet port.

7. A pump as claimed in claim 6 in which said one volume first communicates with said inlet port when the distance between the pitch point of the gears and the leading point of contact the gears is between 0.5 and 0.6 of the base pitch of the gears.

* * * * *